US005678321A

United States Patent [19]

Deshpande et al.

[11] Patent Number: 5,678,321

[45] Date of Patent: Oct. 21, 1997

[54] AIR CAPS FOR TWO TIER DOUBLE FELTED DRYER

[75] Inventors: Rajendra D. Deshpande, Rockton; Jeffrey H. Pulkowski, Roscoe, both of Ill.

[73] Assignee: Beloit Technologies, Inc., Wilmington, Del.

[21] Appl. No.: 700,241

[22] Filed: Aug. 20, 1996

Related U.S. Application Data

[63] Continuation-in-part of Ser. No. 657,754, May 30, 1996, which is a continuation-in-part of Ser. No. 527,048, Sep. 12, 1995, Pat. No. 5,600,898.

[51] Int. Cl.[6] ..... F26B 11/02

[52] U.S. Cl. ..... 34/115; 34/114

[58] Field of Search ..... 34/114, 115, 116, 34/117, 120, 123

[56] References Cited

U.S. PATENT DOCUMENTS

| | | | |
|---|---|---|---|
| 3,134,653 | 5/1964 | Justus et al. | 34/114 |
| 4,183,148 | 1/1980 | Koski et al. | 34/23 |
| 4,882,854 | 11/1989 | Wedel et al. | 34/115 |
| 5,033,207 | 7/1991 | Sturm et al. | 34/115 |
| 5,046,266 | 9/1991 | Autio | 34/120 |
| 5,063,689 | 11/1991 | Sollinger | 34/115 |
| 5,065,529 | 11/1991 | Skaugen et al. | 34/117 |
| 5,101,577 | 4/1992 | Wedel | 34/114 |
| 5,269,074 | 12/1993 | Sims et al. | 34/117 |
| 5,279,049 | 1/1994 | Skaugen et al. | 34/115 |
| 5,388,347 | 2/1995 | Kerttula et al. | 34/457 |
| 5,416,980 | 5/1995 | Ilvespää | 34/117 |
| 5,426,867 | 6/1995 | Yli-Kauppila et al. | 34/452 |
| 5,495,678 | 3/1996 | Ilmarinen et al. | 37/117 |

FOREIGN PATENT DOCUMENTS 0 620 313 A2 10/1994 European Pat. Off. .

OTHER PUBLICATIONS

"Thermal Contact Conductance of a Moist Paper Handsheet/Metal Interface," Asensio, Seyed-Yagoobi, Fletcher, and Pulkowski, HTD-vol. 180, pp. 57–63, *Fundamentals of Forced and Mixed Convection and Transport Phenomena*, ASME 1991.

*Primary Examiner*—Henry A. Bennett
*Assistant Examiner*—Dinnatia Doster
*Attorney, Agent, or Firm*—Lathrop & Clark

[57] ABSTRACT

A new dryer section or an existing dryer section of the two tier double-felted type has air caps disposed over the upper dryer rolls to simultaneously dry both sides of the web to increase drying rates. The heated pressurized air is blown through multiple air impingement holes in the air cap nozzle plates to impinge the web at a temperature of 500–900 degrees Fahrenheit and air speeds of 20,000–40,000 feet per minute. The dryer fabric employed is foraminous with a permeability of between 400–1,200 cubic feet per minute per square foot and is designed to withstand peak temperatures of up to 900 degrees Fahrenheit and average temperatures of between 500–600 degrees Fahrenheit. The design of the air caps utilizes recirculation of the blowing air to control drying rates.

3 Claims, 4 Drawing Sheets

AIR CAPS FOR TWO TIER DOUBLE FELTED DRYER

RELATED APPLICATION

This application is a continuation-in-part of application Ser. No. 08/657,754 filed May 30, 1996 which is a continuation-in-part of application Ser. No. 08/527,048, filed Sep. 12, 1995, now U.S. Pat. No. 5,600,898 the disclosures of which are hereby incorporated by reference herein.

FIELD OF THE INVENTION

This invention relates to dryers used in papermaking in general and in particular to dryers of the two tier type.

BACKGROUND OF THE INVENTION

Paper is made by forming a mat of fibers, normally wood fibers, on a moving wire screen. The fibers are in a dilution with water constituting more than ninety-nine percent of the mix. As the paper web leaves the forming screen, it may be still over eighty percent water. The paper web travels from the forming or wet end of the papermaking machine and enters a pressing section where, with the web supported on a dryer fabric, the moisture content of the paper is reduced by pressing the web to a fiber content of between forty-two and forty-five percent. After the pressing section, the paper web is dried on a large number of steam heated dryer rolls, so the moisture content of the paper is reduced to about five percent.

The dryer section makes up a considerable part of the length of a papermaking machine. The web as it travels from the forming end to the take-up reel may extend a quarter of a mile in length. A major fraction of this length is taken up in the dryer section. As the paper industry has moved to higher web speeds, upwards of four- to five-thousand feet per minute, the dryer section has had to become proportionately longer because less drying is accomplished at each dryer as the paper moves more quickly through the dryers. Increasing the length of an existing dryer section is often difficult and costly, especially where increases in the building length are required to house the longer machine. Existing papermaking machines are under economic pressure to increase paper speed to remain cost competitive. Higher paper speeds however require more drying capability in the dryer section.

One type of dryer widely used in existing papermaking machines is known as a two-tier dryer, and has two rows of steam heated dryer rolls four to seven feet in diameter. The dryer rolls in the upper and lower rows are staggered. The paper web runs in a meandering fashion from an upper dryer roll to a lower dryer roll and then on to an upper roll over as many rolls as is required. An upper dryer fabric backs the web as it travels over the upper dryer rolls, and leaves the paper web as it travels to the lower rolls. The upper dryer fabric is turned by dryer fabric reversing rolls spaced between the upper rolls. On the lower dryer rolls the web is supported by a lower dryer fabric, which is also turned between lower dryer rolls by lower dryer fabric reversing rolls. This apparatus advantageously dries first one side and then the other of the web.

Justus et al. disclose that the drying capability of a two tier dryer can be increased by using air caps. However Justus et al. is over 35 years old and is not known to have been implemented in an economic machine. Justus et al. teaches the necessity of utilizing dryer felts capable of withstanding temperatures on the order of 300 degrees Fahrenheit. Such low temperatures combined with suggested air speeds of 10,000 to 20,000 feet per minute are insufficient to justify the cost of adding air caps to existing dryer systems. Justus et al. suggest that the dryer felt can be provided by any foraminous or reticulated material of sufficient porosity or air permeability to permit the passage therethrough of the impinging air streams.

Koski et al. show a two tier dryer with two air caps over two dryers near the wet end of a dryer section. The dryer section of koski et al. has two felts in engagement with the paper as it passes over the dryer rolls and under the air caps. Because the web is underlain by a felt, heat transfer to the web is limited from the dryer roll which is enclosed by the air caps.

Kerttula et al. in FIG. 7 disclose placing an air cap over a reversing roll in a single tier dryer system. The reversing roll is of the vacuum type and holds the web onto a dryer felt which underlies the web. A vacuum reversing roll by definition can't be steam heated and if it were replaced with a heated roll the positioning of the felt between the web and the dryer surface would prevent effective heat transfer between the dryer and the web. Furthermore, vacuum is required by Kerttula et al. in order to hold the web onto the dryer while air is blown directly onto the web.

Ilmarinen et al. likewise disclose placing a wire or dryer fabric between the surface of the dryer rolls and the web where air caps are positioned over the dryer.

What is needed is a dryer section which dries both sides of the web simultaneously and which can be applied to existing two tier dryer sections.

SUMMARY OF THE INVENTION

The dryer section of this invention may be installed as part of a new papermaking machine, or may be installed as a retrofit to an existing dryer section of the two tier double felted type. Air caps are employed over the dryer rolls to simultaneously dry both sides of the web to increase drying rates. The air caps employ blown air at a temperature of 500–900 degrees Fahrenheit and air speeds of 20,000–40,000 feet per minute. The dryer fabric employed is foraminous with a permeability of between 400–1,200 cubic feet per minute per square foot and is designed to withstand peak temperatures of up to 900 degrees Fahrenheit and average temperatures of between 500–600 degrees Fahrenheit. The design of the air caps utilizes recirculation of the blowing air to control drying rates. Existing two tier dryers can be retrofit with a high temperature felt and air caps. Air caps are particularly advantageous on the last dryer in the dryer section where conventional steam heated dryers begin to lose their effectiveness. Installing air caps on existing machines allows increased drying capability without increased dryer section length. Increased drying capability in turn allows increased operating speed which improves the economic performance of an existing papermaking machine.

It is a feature of the present invention to provide a papermaking dryer apparatus which provides an increased rate of drying of a paper web.

It is another feature of the present invention to provide a method and apparatus for increasing the drying capabilities of existing two tier papermaking dryer sections.

It is a further feature of the present invention to provide a papermaking dryer which prevents the formation of curl in the paper web being dried.

It is yet another feature of the present invention to provide a dryer section of a papermaking machine which controls curl and maximizes onesideness of the paper formed.

Further objects, features and advantages of the invention will be apparent from the following detailed description when taken in conjunction with the accompanying drawings.

DESCRIPTION OF THE PREFERRED EMBODIMENT

Figure 1:
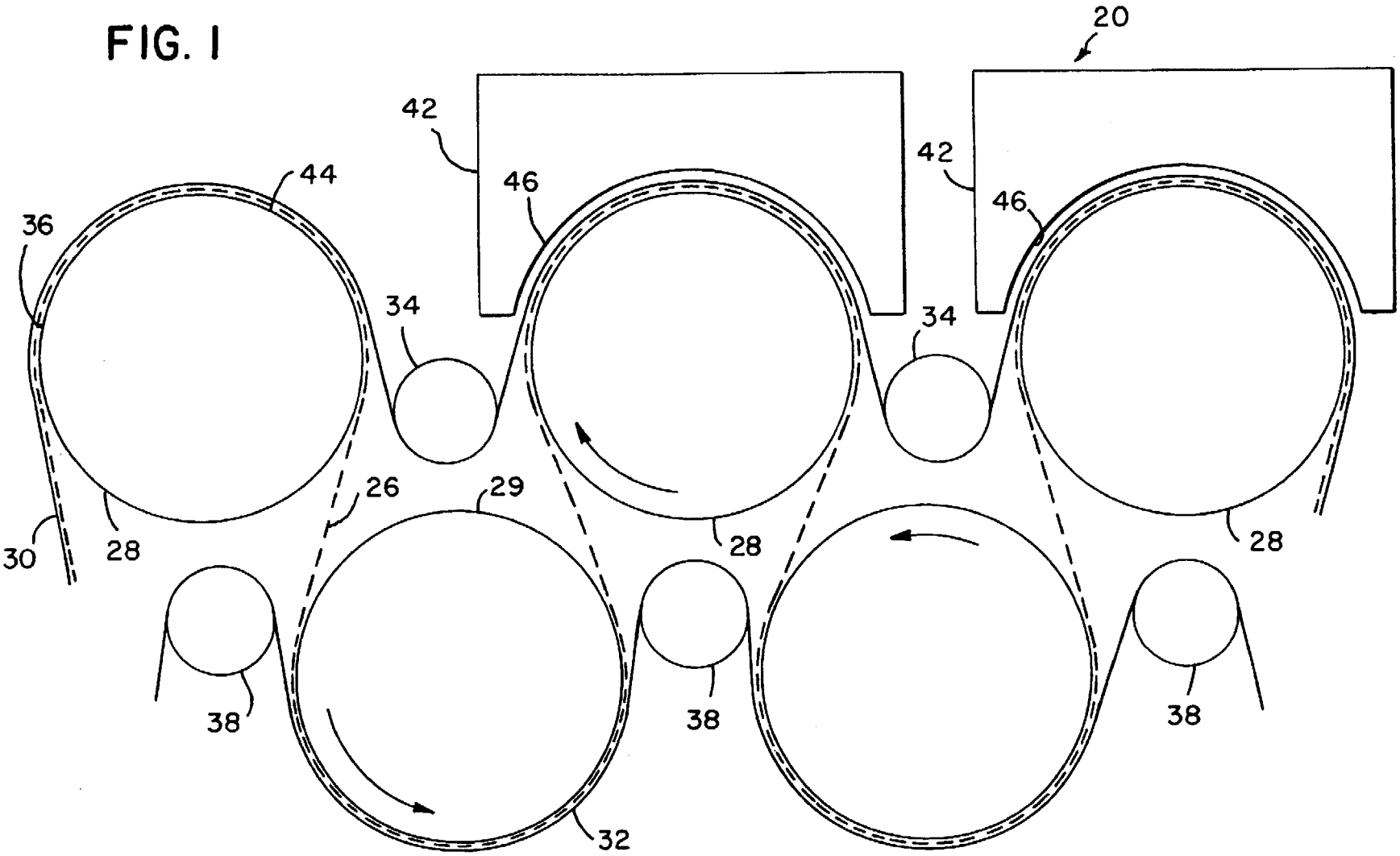
FIG. 1 is a schematic view of a two tier double-felted dryer section of this invention.

Referring more particularly to FIGS. 1–7, wherein like numbers refer to similar parts, a two tier dryer section 20 is shown in FIG. 1. The two tier dryer section 20 is part of a papermaking machine 22, shown schematically in FIG. 6. The papermaking machine is housed in a building 24, and typically will include a former section and a pressing section ahead of the dryer section 20, as well as a calender section and a reel section after the dryer section.

In order to avoid irregularities and tendencies to curl in the produced paper, it is desirable to dry the web 26 on both sides. Unidirectional drying of the paper web results in dimensional changes between the dryer side and the dryer fabric side of the web which, in turn, results in a permanent set or curling in the paper web.

The dryer section 20 incorporates a conventional two tier double-felted dryer section. As shown in FIG. 1, the web 26 passes alternatively from heated upper dryer cylinders or rolls 28 to heated lower dryer rolls 29, so that first one side and then the other of the web 26 is subjected to drying by contact with the a dryer surface 36. The web 26 is supported as it passes over the upper dryer rolls 28 by a first dryer fabric 30 which overlies the web, and as it passes beneath the lower dryer rolls 29 by a second dryer fabric 32 which is positioned outwardly from the web. The upper first dryer fabric 30 extends over rolls 34 as it passes between upper dryer rolls. The second dryer fabric 32 extends over rolls 38 as it passes between lower dryer rolls 29.

The dryer section 20 employs air caps 42 to dry the dryer fabric side of the web. The air caps 42 are hoods which overlie the upper portions 44 of the dryer rolls 24 and blow high velocity hot air through the dryer fabric to dry the upper surface of the web simultaneously with (and preferably at the same rate as) the roll side of the paper which is dried by the steam heat transmitted to the surface 36 of the upper dryer rolls 28.

The air caps 42 augment the evaporation rate of a steam heated drying cylinder. Each air cap 42 is located above an upper dryer roll 28, as shown in FIG. 1, and impinges hot air through the dryer fabric and onto the web.

Figure 3:
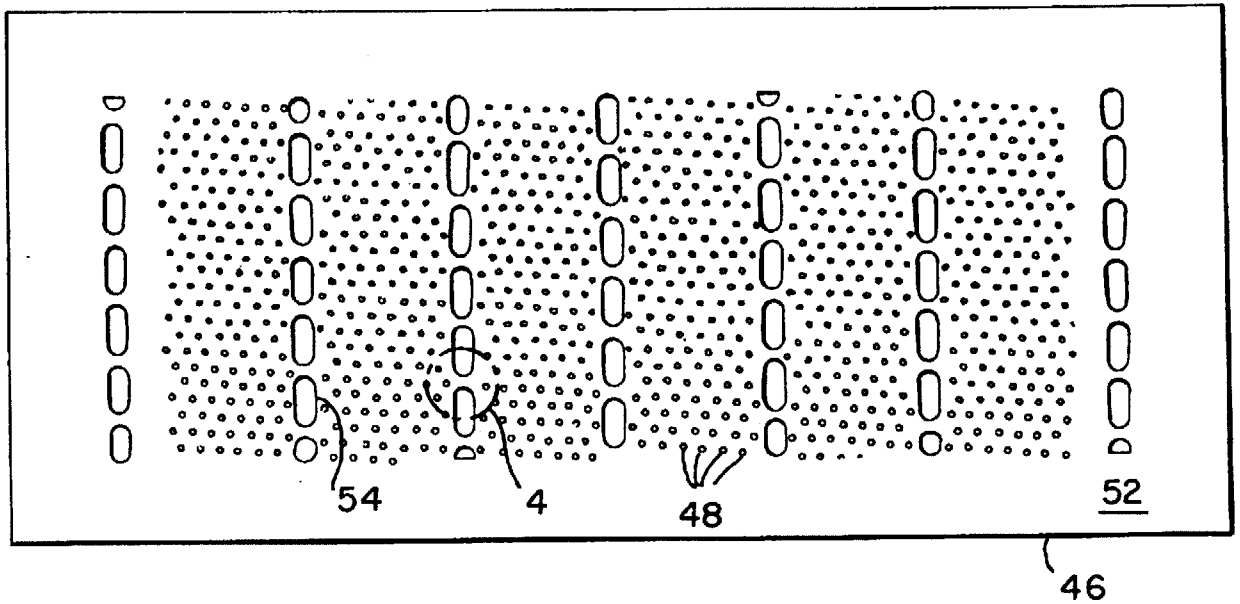
FIG. 3 is a flat development view of the sheet metal which comprises the air cap plate of FIG. 2.
Figure 2:
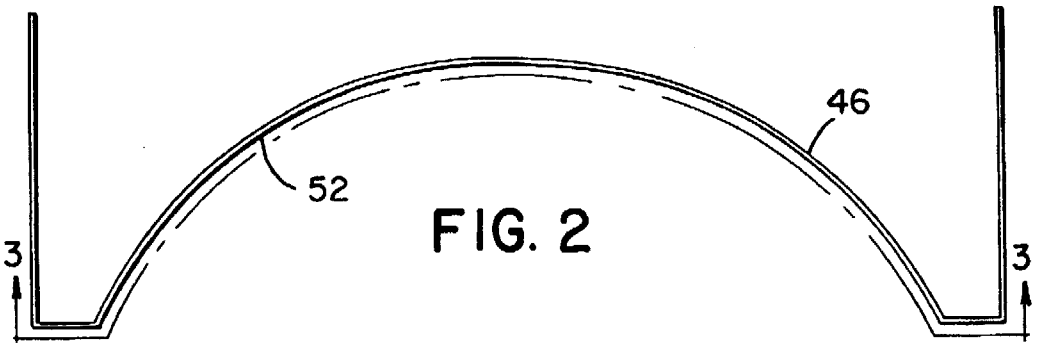
FIG. 2 is a side elevational view of a nozzle plate of an air cap of the dryer section of FIG. 1.
Figure 5:
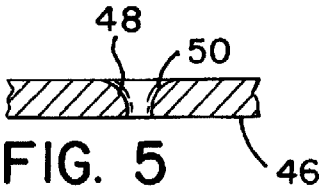
FIG. 5 is a cross-sectional view of a hole in the sheet metal part of FIG. 4, taken along section line 5—5.
Figure 4:
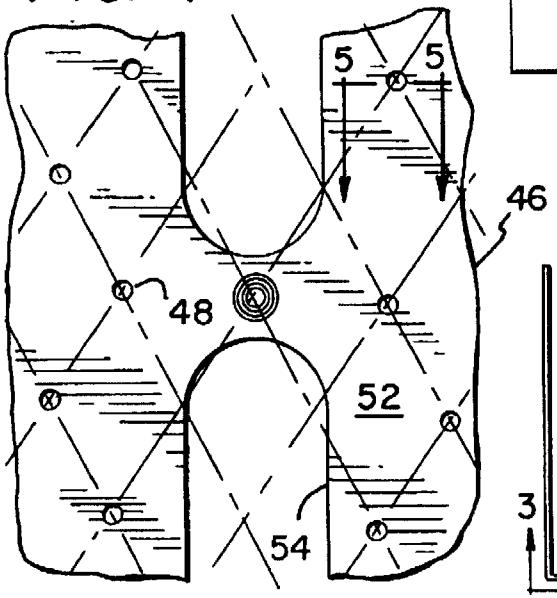
FIG. 4 is an enlarged view of a fragment of the sheet metal part of FIG. 3, taken at the area 4.
Figure 6:
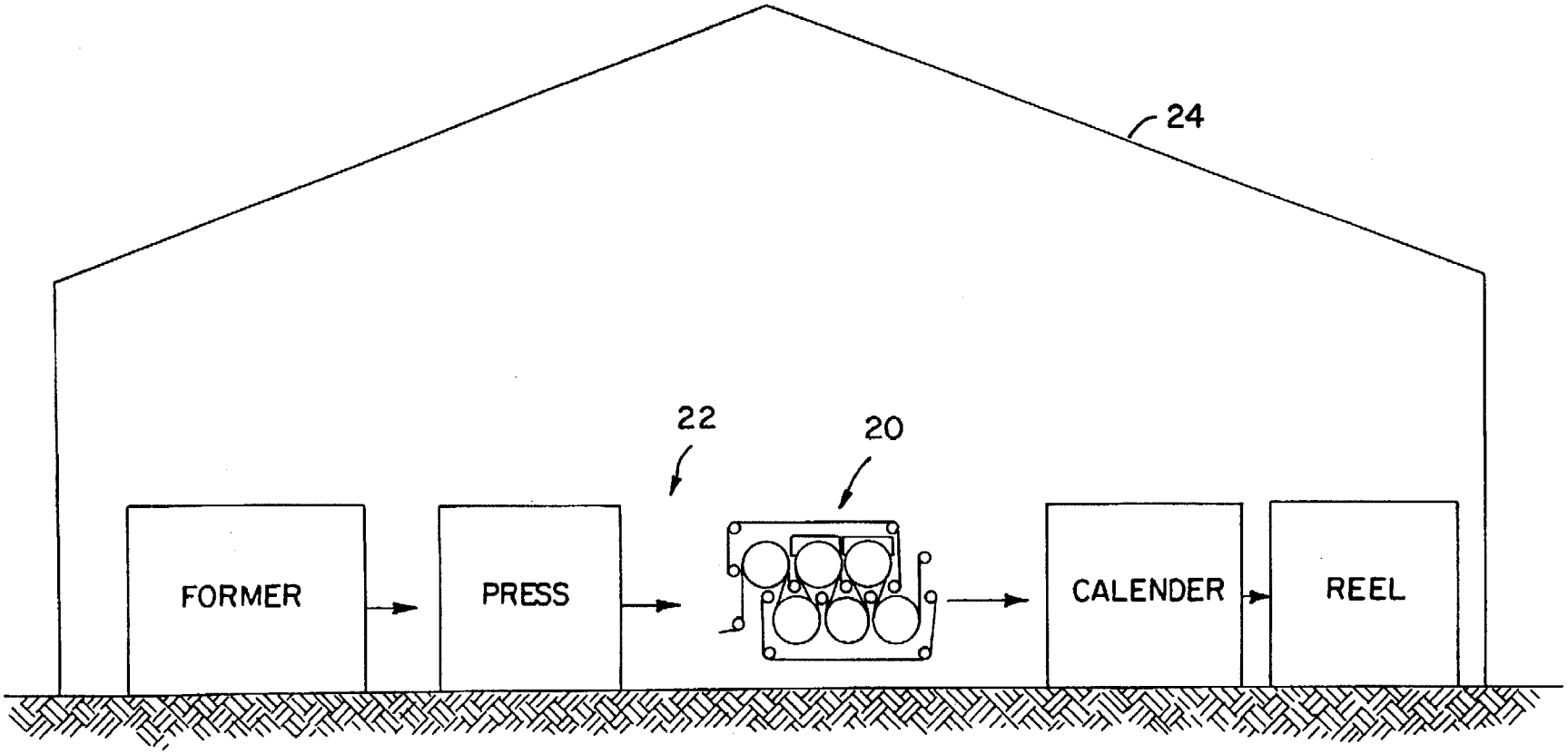
FIG. 6 is a schematic representation of a retrofitted embodiment of the dryer section of this invention on a papermaking machine within a machine building.

As shown in FIGS. 2–5, each air cap is supplied by a duct (not shown) with high temperature and pressure air. The air cap 42 has a metal hood 46 or nozzle plate, shown in FIG. 2, which is comprised of sheet metal formed to curve around the heated dryer roll 28. For best performance, the hood should be formed to maintain a constant distance from the surface of the dyer fabric beneath it, for example one inch. Numerous air impingement holes 48 having a discharge diameter of 0.20 inches are formed in the hood 46. Each hole, as shown in FIG. 5, is formed with an inlet 50 which decreases in diameter as it approaches the inside surface 52 of the hood 46. The thickness of the sheet metal forming the hood 46 may be approximately 0.25 inches, the maximum diameter of the inlet 50 being approximately 0.58 inches, and the radius of the curve on the inlet being approximately 0.19 inches. The result of the decreasing diameter of the inlet holes is an increase in the velocity of the air as it reaches the dryer fabric and then the web 26. The air impingement holes 48, as shown in FIG. 4, are positioned in a pattern which is offset from parallelness to the strict machine direction, for example by about 3.9 degrees. The result of this staggering of the holes is that all areas of the web will see a uniform air flow as the web travels under the air cap.

As shown in FIG. 3, a number of slots 54, approximately 2 inches wide, extend in the cross machine direction and serve to exhaust the air once it has been blown on the dryer fabric and web. The air caps 42 are supplied with air in a closed-loop air supply system. Spent impingement air from the caps is scavenged through the slots 54, which serve as exhaust openings in the nozzle plate 46. The exhaust air is returned back to a main supply blower where it is compressed, sent to a burner, and then back to the air caps. To maintain desired impingement air humidity level, a percentage of the exhaust is vented to atmosphere and fresh make-up air is added to the system. The air caps may be mounted to the papermaking machine frame for pivoting movement away from the upper dryer rolls 28 to permit access to the rolls 28 as needed.

In order to allow the passage of air through the dryer fabric 30, the dryer fabric must be of a porous or foraminous nature. Thus, the dryer fabric employed in the dryer section 20 will have a porosity in the range of four-hundred to twelve-hundred cubic feet per minute per square foot at one-half inch of water as typically measured by those skilled in the art of the design and construction of papermaking dryer fabrics. Conventional thinking in the papermaking industry is that runnability problems limit dryer fabric permeability to less than 90 cubic feet per minute. The air supplied by the air caps 42 may have a temperature range of four-hundred (Preferably 500 or more) to nine-hundred degrees Fahrenheit and be blown at a velocity of between eight-thousand and forty-thousand feet per minute. The high air temperatures require dryer fabrics which can withstand up to nine-hundred degrees Fahrenheit for brief periods of time and steady-state temperatures in the range of five-hundred to six-hundred degrees Fahrenheit.

Dryer fabrics of this nature may be constructed of metal, high temperature plastics such as polyetheretherketone (PEEK), or polyphenylene Sulfide (PPS) also sold as Ryton® fibers and manufactured by Phillips Petroleum Company, or other high temperature materials such as Nomex® fiber produced by E. I. Du Pont de Nemours Corporation, 1007 Market St., Wilmington Del., which can be formed into the necessary fibers. The preferred dryer fabric materials appear to be those woven from fine spiral fibers of long length, an example of a company currently developing dryer fabrics with high temperature capability is Diao Bo of Japan, a division of Mitsubishi Heavy Industries, MHI 2-51, Marunouchi, Chiyoda-KU, Tokyo 100, Japan.

Figure 7:
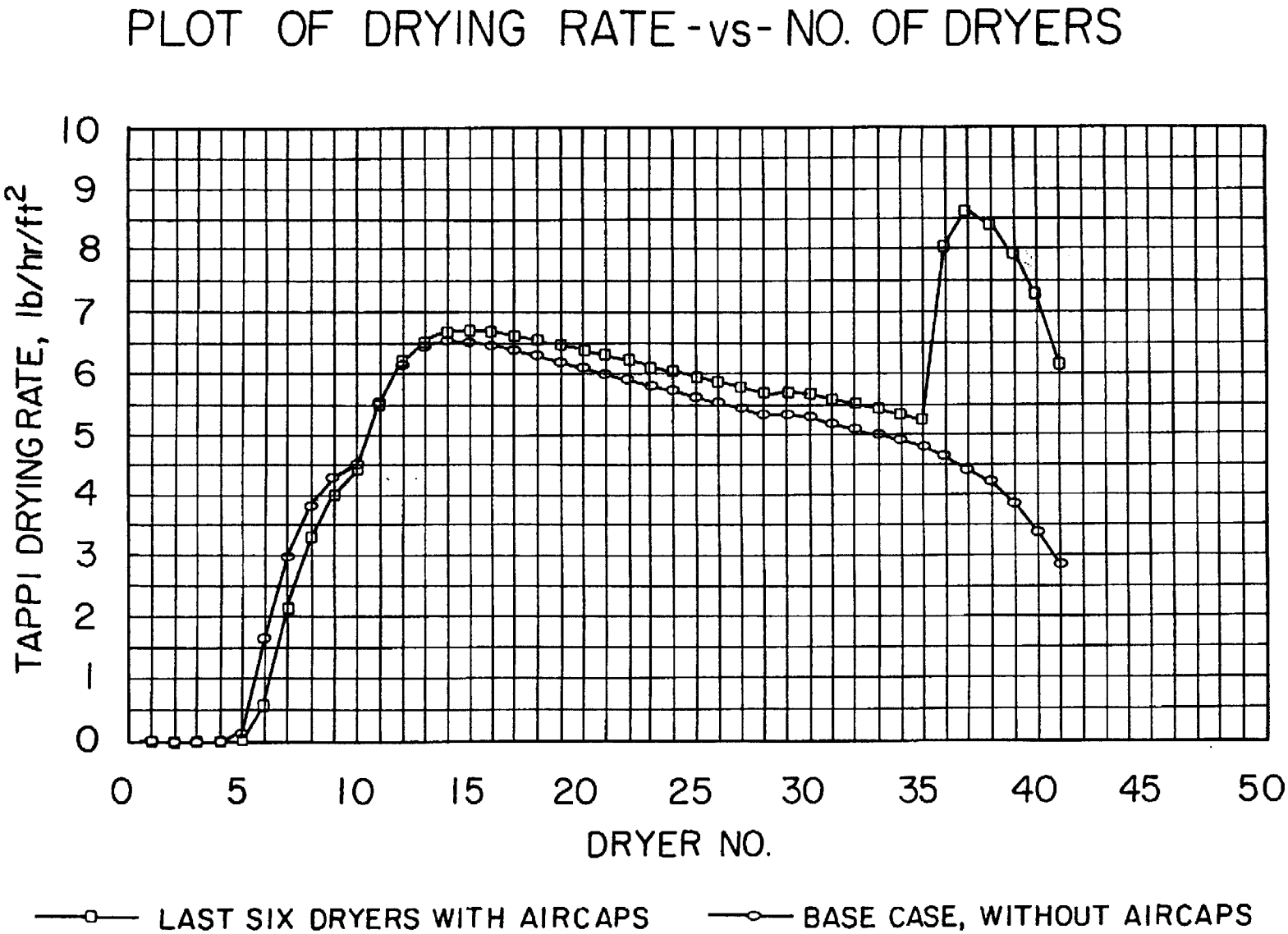
FIG. 7 is a graph of drying rate vs. number of dryers for a conventional dryer section and one employing the dryer section with air caps of this invention.

The effect of the dryer section of this invention with air caps versus a dryer section without air caps is illustrated in the chart of FIG. 7. For example, a papermaking machine with 41 dryer rolls can run at 4450 feet per minute without air caps. By adding air caps to the last six dryers, machine speed can be increased to 55130 feet per minute, a 15 percent increase. As shown in FIG. 7, the final dryer rolls without air caps tend to have markedly less efficiency in removing moisture than the preceding dryers. By adding air caps, the rate of moisture removal is significantly improved.

The dryer section 20 of this invention is of particular utility where it is desired to retrofit a conventional two tier double felted dryer section. As illustrated in the schematic view of FIG. 6, an existing papermaking machine will include a number of significant sections of machinery both upstream and downstream of the dryer section. For increased production of any papermaking machine, the operating speed must be increased. Yet increased web speed means reduced residency time of the web at any particular dryer roll. Adding additional dryer rolls to an existing papermaking machine is a costly option-requiring the displacement of large segments of the papermaking machine with new foundations and costly adjustments. Where the building is of limited size, there may be insufficient space for additional rolls. By retrofitting an existing papermaking machine dryer section to include the air caps of this invention, additional drying capacity can be provided without moving any substantial elements of the existing machine.

Hence, without regard to the capacity of the existing dryer section, the speed of web formation of the existing components of the papermaking machine may be increased by a selected percentage by adding air caps to the dryer starting with the last dryer until approximately as many air caps are added as existing dryer rolls multiplied by the selected percentage increase times 0.7. Then the dryer fabric of the existing machine which overlies the upper dryer rolls is replaced with a new dryer fabric capable of withstanding a temperature of at least 500 degrees Fahrenheit and having a porosity of between four-hundred and twelve-hundred cubic feet per minute per square foot at one-half inch of water. The improved papermaking machine is then operated and air blown at about 28,000 feet per minute at a temperature of at least 500 degrees Fahrenheit onto the web as it passes through each air cap.

It is understood that the invention is not limited to the particular construction and arrangement of parts herein illustrated and described, but embraces such modified forms thereof as come within the scope of the following claims.

We claim:

1. A dryer section in a papermaking machine comprising:

a set of dryer cylinders including a plurality of upper dryer cylinders and a plurality of lower dryer cylinders such that upper and lower dryer cylinders alternate, said dryer cylinders being arranged to define a path between dryer cylinders for travel of a web of paper to run from one dryer cylinder to a next dryer cylinder of said set of dryer cylinders so that the paper web is brought into direct contact with each dryer cylinder, wherein a first side of the web is brought into direct contact with the one dryer cylinder and a second side is brought into direct contact with the next dryer cylinder;

an upper dryer fabric which engages portions of the paper web where it wraps the upper dryer cylinders;

a lower dryer fabric which engages portions of the paper web where it wraps the lower dryer cylinders; and a plurality of air caps positioned over the upper dryer cylinders, wherein each air caps has a foraminous metal plate through which air heated to about 500 degrees Fahrenheit is blown, the plates having holes of about 0.20 inches in diameter spaced about one inch from the upper dryer fabric, wherein the upper dryer fabric has a porosity of four-hundred to twelve-hundred cubic feet per minute per square foot at one-half inch of water.

2. A method of drying a paper web comprising the steps of:

directing a web of paper in a sinuous path over a two tier dryer, the web wrapping first an upper tier dryer roll, followed by wrapping a lower tier dryer roll, the web coming into direct contact with each dryer roll of the upper tier and each dryer roll of the lower tier;

wrapping portions of the upper dryer rolls with at least one upper dryer fabric having a porosity of four-hundred to twelve-hundred cubic feet per minute per square foot at one-half inch of water, wherein the upper dryer fabric overlies portions of the web where it wraps the upper dryer rolls; and blowing air heated to about 500 degrees Fahrenheit at a velocity of about 28,000 feet per minute onto the web through the upper fabric, wherein the air is directed through a multiplicity of holes about 0.20 inches in diameter and spaced about one inch from the web as it wraps the upper dryer rolls.

3. A method of improving the operational speed of an existing papermaking machine having a two tier dryer system of the type which directs a web of paper in a sinuous path over each dryer roll in the two tier dryer, the web wrapping first an upper tier dryer roll followed by wrapping a lower tier dryer roll, the web coming into direct contact with each dryer roll of the upper tier and each dryer roll of the lower tier, and portions of the web on the upper dryer roll being overlain by an upper dryer fabric which engages the web on the upper dryer roll, and portions of the web on the lower dryer roll are wrapped by a lower dryer fabric that is in direct contact with the paper web, the method comprising the steps of:

without regard to the capacity of the dryer section increasing the speed of web formation of the existing components of the papermaking machine by a selected percentage;

adding air caps to the dryer section starting with the last dryer roll, until approximately as many air caps are added as existing dryer rolls times the selected percentage increase of the web speed times 0.7;

replacing at least each upper dryer fabric which overlies the web on an upper tier dryer with an air cap with a new dryer fabric capable of withstanding a temperature of at least 500 degrees Fahrenheit, the new dryer fabric having a porosity of four-hundred to twelve-hundred cubic feet per minute per square foot at one-half inch of water; and operating the improved papermaking machine and blowing air at about 28,000 feet per minute and having a temperature of at least 500 degrees Fahrenheit onto the web as it passes through each air cap.

* * * * *